US006380132B1

(12) United States Patent
Mihara et al.

(10) Patent No.: US 6,380,132 B1
(45) Date of Patent: Apr. 30, 2002

(54) THERMAL TRANSFER IMAGE-RECEIVING SHEET AND PROCESS FOR PRODUCING THE SAME

(75) Inventors: Kiyomaro Mihara; Kenji Tsuda; Wataru Ohyama, all of Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/493,209

(22) Filed: Jan. 28, 2000

(30) Foreign Application Priority Data

Jan. 28, 1999 (JP) ..... 11-019404
Apr. 26, 1999 (JP) ..... 11-117449

(51) Int. Cl.[7] ..... B41M 5/035; B41M 5/38
(52) U.S. Cl. ..... 503/227; 428/195
(58) Field of Search ..... 8/471; 428/156, 428/195, 913, 914, 43; 503/227; 156/268

(56) References Cited

U.S. PATENT DOCUMENTS 5,393,727 A * 2/1995 Egashisa et al. ..... 503/227
5,811,371 A * 9/1998 Egashisa et al. ..... 503/227
6,162,517 A * 12/2000 Oshima et al. ..... 428/40.1

FOREIGN PATENT DOCUMENTS

JP 08282135 * 10/1996
JP 09315020 * 12/1997
JP 10100495 * 4/1998
JP 10157318 * 6/1998
JP 10329436 * 12/1998

* cited by examiner

*Primary Examiner*—Bruce H. Hess
(74) *Attorney, Agent, or Firm*—Parkhurst & Wendel, L.L.P

(57) ABSTRACT

A thermal transfer image-receiving sheet 1 includes a seal part 9 including at least a receptive layer 8, a substrate 7 and a pressure-sensitive adhesive layer 6 which are laminated in the order mentioned; and a release sheet 5 which is separably adhered to the pressure-sensitive adhesive layer 6 of the seal part 9. The seal part 9 is provided with a half cut 2 that is useful for separating a part of the seal part 9 from the release sheet 5. The groove width of the half cut 2 is preferably from 25 to 60 $\mu$m. It is also preferable that the seal part 9 and the release sheet 5 be adhered to each other so that they show continuous and slight changes in peel strength when the seal part 9 is separated from the release sheet 5. The slight changes in peel strength measured in accordance with JIS Z0237-8.3.1 (180 Degrees Peeling Method) are preferably in the range of 1 to 10 g/cm. Further, it is preferable that the mean peel strength be from 10 to 75 g/cm.

14 Claims, 6 Drawing Sheets

THERMAL TRANSFER IMAGE-RECEIVING SHEET AND PROCESS FOR PRODUCING THE SAME

BACKGROUND OF THE INVENTION

1. Field of the Invention

The present invention relates to a thermal transfer image-receiving sheet on which an image can be formed by means of thermal transfer printing. More particularly, the present invention relates to a thermal transfer image-receiving sheet comprising a seal part including at least a receptive layer, a substrate and a pressure-sensitive adhesive layer which are laminated in the order mentioned, and a release sheet (releasing part) which is separably adhered to the pressure-sensitive adhesive layer of the seal part, and to a process for producing such a thermal transfer image-receiving sheet.

2. Description of Related Art

Up to the present time, there have been known a variety of thermal transfer methods. These thermal transfer methods are effected in the following manner: a thermal transfer printing sheet having a colored transfer layer that is formed on a substrate sheet is superposed on the surface of a thermal transfer image-receiving sheet; and heat is applied image-wise to the back surface of the thermal transfer printing sheet by using a thermal head or the like, thereby thermally transferring the colored transfer layer of the thermal transfer printing sheet to the surface of the thermal transfer image-receiving sheet to form thereon an image.

These thermal transfer methods are roughly classified into two types, that is, sublimation transfer type and hot-melt transfer type, depending upon the constitution of the colored transfer layer to be used. Both printing methods of these two types can achieve the formation of full-color images. For instance, transfer printing sheets of three or four colors of yellow, magenta and cyan, and, optionally, black are prepared; and images of these colors are formed one over the other or sequentially by means of thermal transfer printing on the surface of a thermal transfer image-receiving sheet to form thereon a full-color image.

Thanks to the development of hardware and software associated with multimedia, these thermal transfer methods are expanding their market as full-color hard copying systems for computer graphics, still pictures transmitted via satellite communication, digital images represented by those images stored in CD-ROM or the like, and analog images such as video-taped images.

Thermal transfer image-receiving sheets on which images will be formed by these thermal transfer methods have various practical applications. Typically, they can be used as proof sheets, and as recording sheets for output images, output plans or designs drawn by CAD/CAM or the like, or images output from a variety of medical analyzers or measuring instruments such as CT scanners and endoscopic cameras. They can also be used as the alternative of instant photo, and as paper for producing ID cards, credit cards, and other cards on which facial photos, etc. will be printed, or for producing synthetic or memorial photos which are taken at amusement facilities such as recreation parks, game centers, museums, aquariums and the like.

Further, a thermal transfer image-receiving sheet that can be adhered to any object has also come to be used with the diversification of applications of thermal transfer image-receiving sheets as described above. Such a thermal transfer image-receiving sheet comprises, for example, a seal part including a receptive layer in which an image will be formed, a substrate and a pressure-sensitive adhesive layer which are laminated in this order, the seal part being separably combined to a release sheet through the pressure-sensitive adhesive layer. This is a thermal transfer image-receiving sheet of so-called label or seal type. This thermal transfer image-receiving sheet is used in the following manner: after forming a desired image on the receptive layer, the seal part including the receptive layer is separated from the release sheet, and this seal part separated is adhered to an object through the pressure-sensitive adhesive layer.

As shown in FIGS. 8 and 9 (figures showing the present invention), a thermal transfer image-receiving sheet 1 includes a plurality of sections, and each section is provided with a rectangular half cut 2. An image 10 is formed in each section, so that a plurality of images 10 are located on one thermal transfer image-receiving sheet 1.

The thermal transfer image-receiving sheet 1 shown in FIGS. 8 and 9 includes a seal part 9 including a receptive layer 8, a substrate 7 and a pressure-sensitive adhesive layer 6 which are laminated in the order mentioned, and a release sheet 5 which is separably adhered to the pressure-sensitive adhesive layer 6 of the seal part 9. In this thermal transfer image-receiving sheet 1, the half cut 2 penetrates the layers of the seal part 9 and reaches to the top of the release sheet 5. After an image 10 is formed in each section that is defined by the half cut 2 formed in the seal part 9, a part of the seal part 9 is separated from the release sheet 5 along the half cut 2. This seal part 9 separated can be adhered to any object 11 (see FIG. 10 (figure showing the present invention)).

SUMMARY OF THE INVENTION

An image can be formed on the above-described thermal transfer image-receiving sheet in the following manner. The thermal transfer image-receiving sheet is firstly fed to a thermal transfer printer; a detector installed in the thermal transfer printer detects the position of the end of this image-receiving sheet. Since information concerning the position of the half cut has been stored in the thermal transfer printer, the thermal transfer image-receiving sheet is carried so that the half cut comes to the right position relative to the thermal head; and an image is then formed.

However, when an image is formed in the above-described manner, various troubles tend to be caused at those parts of the thermal transfer image-receiving sheet where half cuts have been formed (hereinafter referred to as "half-cut-provided parts"). Specifically, the half-cut-provided part lifts to cause, while printing is being conducted by using a thermal head, such troubles that the seal part is unfavorably separated at the raised part and that the pressure-sensitive adhesive agent runs off from the seal part to stick to a thermal transfer printing sheet.

Further, when the thermal transfer image-receiving sheet that is curled is carried by a thermal transfer printer or the like, or when heat is applied, by a thermal head, to the thermal transfer image-receiving sheet to print thereon an image, the seal part is unfavorably separated from the release surface of the release sheet at the half-cut-provided part. In particular, when the section on which an image will be formed is small, even such a trouble is caused that the seal part falls off.

The present invention was accomplished in the light of the aforementioned problems. An object of the present invention is therefore to provide a thermal transfer image-receiving sheet free from the lifting of the half-cut-provided parts formed in on the seal part of the thermal transfer image-receiving sheet, which tends to cause, while printing is being conducted by using a thermal head, such troubles that the seal part is unfavorably separated at the raised part and that the pressure-sensitive adhesive agent runs off from the seal part to stick to a thermal transfer printing sheet; and a process for producing such a thermal transfer image-receiving sheet.

Another object of the present invention is to provide a thermal transfer image-receiving sheet free from such a problem that the seal part is unfavorably separated from the release sheet when the thermal transfer image-receiving sheet is carried by a thermal transfer printer, or when printing is conducted by using a thermal head; and a process for producing such a thermal transfer image-receiving sheet.

The first aspect of the present invention is a thermal transfer image-receiving sheet comprising: a seal part including at least a receptive layer, a substrate and a pressure-sensitive adhesive layer which are laminated in the order mentioned; and a release sheet which is separably adhered to the pressure-sensitive adhesive layer of the seal part, wherein the seal part is provided with a half cut for separating a part of the seal part from the release sheet and wherein the half cut has a groove width of 25 to 60 $\mu$m.

In the above-described first aspect of the present invention, it is preferable that the shearing force of the pressure-sensitive adhesive layer of the seal part, measured in accordance with JIS (Japanese Industrial Standards) Z0237-3 be in the range of 800 to 1600 gf.

The second aspect of the present invention is a thermal transfer image-receiving sheet comprising: a seal part including at least a receptive layer, a substrate and a pressure-sensitive adhesive layer which are laminated in the order mentioned; and a release sheet which is separably adhered to the pressure-sensitive adhesive layer of the seal part, wherein the seal part and the release sheet are adhered to each other so that they show continuous and slight changes in peel strength when the seal part is separated from the release sheet.

In the above-described second aspect of the present invention, it is preferable that the slight changes in peel strength measured by the 180 Degrees Peeling Method according to JIS Z0237-8.3.1 be in the range of 1 to 10 g/cm. It is also preferable that the mean peel strength be from 10 to 75 g/cm. Further, it is preferable that the release surface of the release sheet be roughened. It is also preferable that the release sheet is composed of a release layer which is in contact with the pressure-sensitive adhesive layer, and a release substrate which supports the release layer, and wherein either the release layer or the release substrate be roughened.

Furthermore, in the second aspect of the present invention described above, it is preferable that the seal part be provided with a half cut for separating a part of the seal part from the release sheet. The groove width of the half cut is preferably from 25 to 60 $\mu$m.

The third aspect of the present invention is a process for producing a thermal transfer image-receiving sheet, comprising the steps of: preparing a thermal transfer image-receiving sheet including a seal part including a receptive layer, a substrate and a pressure-sensitive adhesive layer which are laminated in the order mentioned, and a release sheet which is separably adhered to the pressure-sensitive adhesive layer of the seal part; and putting a cutter blade in the seal part of the thermal transfer image-receiving sheet to form a half cut with a groove width of 25 to 60 $\mu$m, for separating a part of the seal part from the release sheet.

In the above-described third aspect of the present invention, it is preferable that the nose angle of the cutter blade be in the range of 25 to 500° and that the nose length of the same be greater than the thickness of the seal part.

According to the first and third aspects of the present invention, the half cut for separating a part of the seal part from the release sheet is formed so that the groove width of the half cut will be from 25 to 60 $\mu$m. Therefore, such troubles can be prevented that the half-cut-provided part lifts to cause, while printing is being conducted by using a thermal head, the unfavorable separation of the seal part from the release sheet, or the running off of the pressure-sensitive adhesive agent from the seal part to stick to a thermal transfer printing sheet.

According to the second aspect of the present invention, the seal part and the release sheet are adhered to each other so that they show continuous and slight changes in peel strength when the seal part is separated from the release sheet. Therefore, such a trouble can be avoided that the seal part is unfavorably separated from the releasing part while a thermal transfer printer is carrying the thermal transfer image-receiving sheet, or when printing is conducted by using a thermal head.

BRIEF DESCRIPTION OF THE DRAWINGS

By referring now to the accompanying drawings, preferred embodiments of the present invention will be described hereinafter. In the drawings.

DESCRIPTION OF THE PREFERRED EMBODIMENTS

First Embodiment

First of all, the outline of the thermal transfer image-receiving sheet according to the first embodiment of the present invention will be described by referring to FIGS. 8 to 10.

Figure 8:
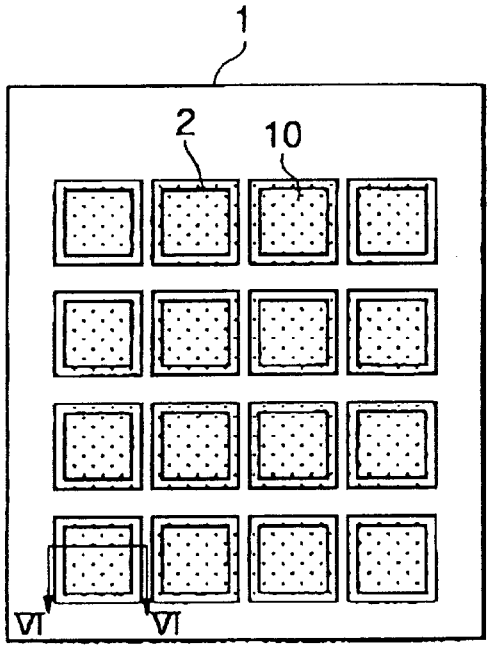
FIG. 8 is a plane view showing one example of the thermal transfer image-receiving sheet according to the first embodiment of the present invention, on which images have been formed by means of thermal transfer printing.
Figure 9:
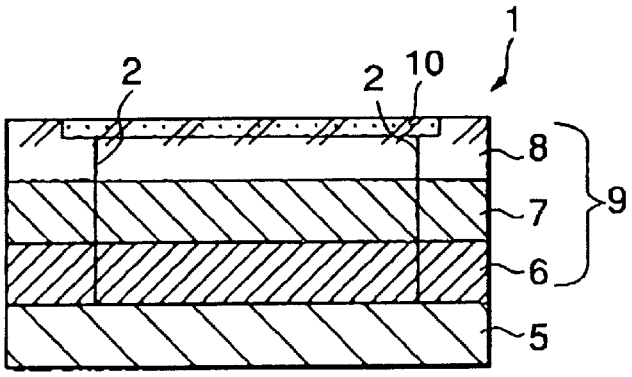
FIG. 9 is an enlarged sectional view taken along line VI—VI in FIG. 8.
Figure 10:
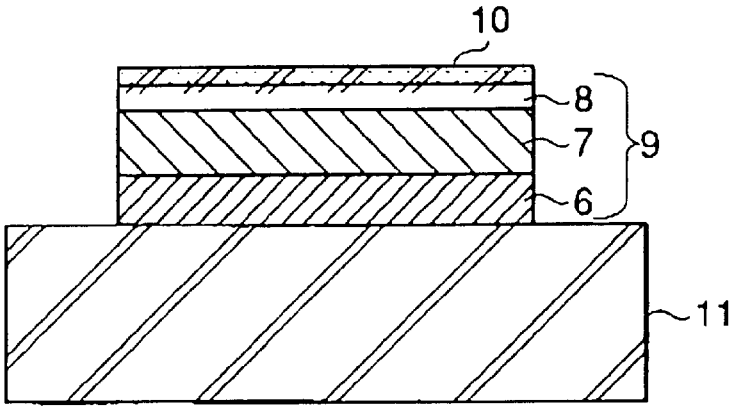
FIG. 10 is a sectional view showing the seal part separated from the thermal transfer image-receiving sheet shown in FIGS. 8 and 9, adhered to an object.

FIG. 8 is a plane view showing one example of the thermal transfer image-receiving sheet according to the first embodiment of the present invention; and FIG. 9 is an enlarged sectional view taken along line VI—VI in FIG. 8. The thermal transfer image-receiving sheet 1 shown in FIGS. 8 and 9 is fed to a thermal transfer printer (not shown in the figures) in sheet form. A thermal transfer printing sheet (not shown in the figures) is superposed on the surface of the thermal transfer image-receiving sheet 1; and heat is applied image-wise to the back surface of the thermal transfer printing sheet by using a thermal head or the like, thereby thermally transferring a colored transfer layer contained in the thermal transfer printing sheet to the surface of the thermal transfer image-receiving sheet 1 to form thereon a desired image 10.

The thermal transfer image-receiving sheet 1 includes a plurality of sections, and each section is provided with a rectangular half cut 2. An image 10 is formed on each section, and a plurality of images 10 are thus located on one thermal transfer image-receiving sheet 1. It is noted that the sections to be provided with the half cut 2 can be made into any shape.

In this thermal transfer image-receiving sheet 1, the half cut 2 penetrates the layers of the seal part 9 and reaches to the top of the release sheet 5. After forming an image 10, for instance, a facial photographic image, in each section on the seal part 9, defined by the half cut 2, a part of the seal part 9 is separated, along the half cut 2, from the release sheet 5 together with the pressure-sensitive adhesive layer 6. This seal part 9 separated can be adhered, as shown in FIG. 10, to any object 11, for example, a notebook, a pocket book, a brief case or the like.

Next, the specific constitution of this thermal transfer image-receiving sheet 1 will be described.

Figure 1A:
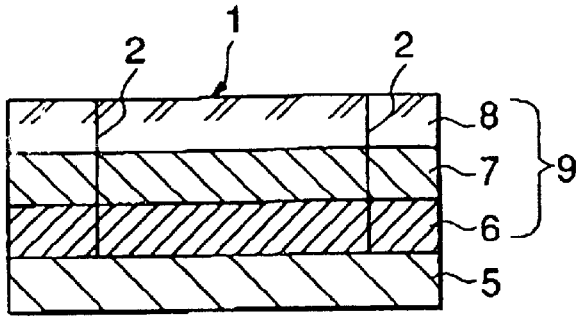
FIG. 1A is a sectional view illustrating a first embodiment of the thermal transfer image-receiving sheet according to the present invention.
Figure 1B:
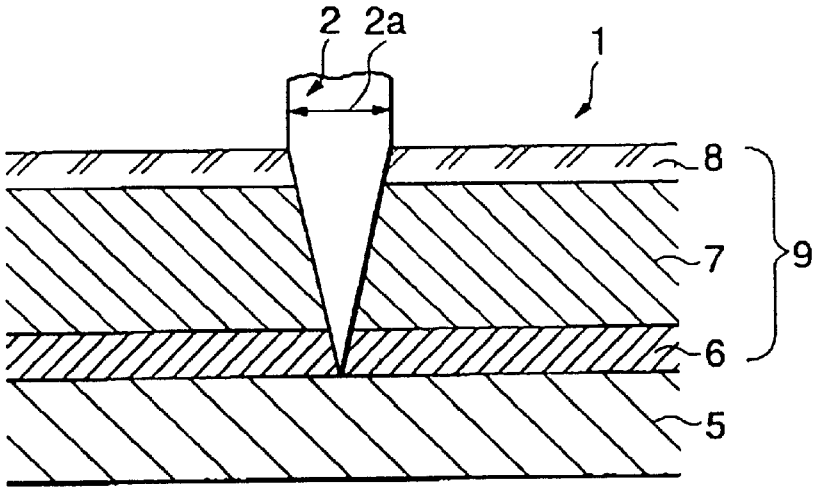
FIG. 1B is an enlarged partial sectional view of the half-cut-provided part of the thermal transfer image-receiving sheet shown in FIG. 1A.

FIG. 1A is a sectional view illustrating the first embodiment of the thermal transfer image-receiving sheet according to the present invention; and FIG. 1B is an enlarged partial sectional view of the half-cut-provided part of the thermal transfer image-receiving sheet shown in FIG. 1A. As shown in FIGS. 1A and 1B, the thermal transfer image-receiving sheet 1 includes a seal part 9 including at least a receptive layer 8, a substrate 7 and a pressure-sensitive adhesive layer 6 which are laminated in the order mentioned; and a release sheet 5 which is separably adhered to the pressure-sensitive adhesive layer 6 of the seal part 9. The seal part 9 is provided with a half cut 2 for separating a part of the seal part 9 from the release sheet 5, the groove width 2*a* of the half cut 2 being from 25 to 60 μm.

The release sheet 5 and the seal part 9 (the pressure-sensitive adhesive layer 6, the substrate 7 and the receptive layer 8) which constitute the thermal transfer image-receiving sheet 1 will be described in detail hereinafter.

(Release Sheet)

A conventionally known plastic film or poly-laminated paper whose surface has been treated with a known releasing agent such as silicone can be used as the release sheet 5. For instance, "Lumirror T-60" (thickness: 50 μm) manufactured by Toray Industries, Inc., Japan, or "W-400" (thickness: 38 μm) manufactured by Dia Foil Kabushiki Kaisha, Japan may be used. The thickness of the release sheet 5 is preferably from 20 to 188 μm. When the release sheet 5 is too thin, the resulting thermal transfer image-receiving sheet 1 is limp, so that it cannot be carried by a thermal transfer printer, or is wrinkled. On the other hand, when the release sheet 5 is too thick, the resulting thermal transfer image-receiving sheet 1 has an excessively large thickness. An excessively heavy load is thus imposed on a thermal transfer printer while the printer is carrying such a thermal transfer image-receiving sheet 1. As a result, the thermal transfer printer gets out of order, or cannot properly carry the thermal transfer image-receiving sheet 1.

(Pressure-Sensitive Adhesive Layer)

Conventionally known solvent-type or aqueous pressure-sensitive adhesive agents can be used for the pressure-sensitive adhesive layer 6. Examples of pressure-sensitive adhesive agents include vinyl acetate resins, acrylic resins, vinyl acetate—acrylic copolymers, vinyl acetate—vinyl chloride copolymers, ethylene—vinyl acetate copolymers, polyurethane resins, natural rubber, chloroprene rubber and nitrile rubber.

It is preferable that the shearing force of the pressure-sensitive adhesive layer 6, measured in accordance with JIS (Japanese Industrial Standards) Z0237 (Method for Testing Pressure-Sensitive Adhesive Tape/Pressure-Sensitive Adhesive Sheet) - 3, be in the range of 800 to 1600 gf. When the shearing force falls in this range, the pressure-sensitive adhesive layer 6 has increased cohesive force, so that the pressure-sensitive adhesive agent does not run off from the half-cut-provided part or edge of the thermal transfer image-receiving sheet 1.

Figure 7:
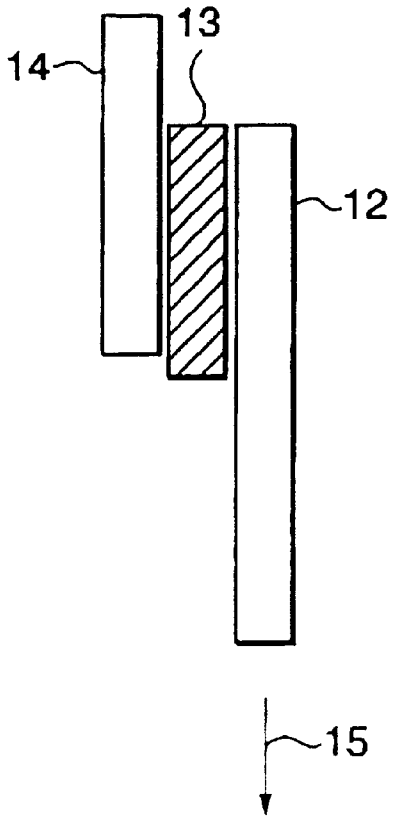
FIG. 7 is a diagrammatic view illustrating a method for measuring the shearing force of a pressure-sensitive adhesive layer.

JIS Z0237-3 defines a test method for evaluating the resisting force of a pressure-sensitive adhesive agent to dynamic shear force. As shown in FIG. 7, in this test method, a pressure-sensitive adhesive layer 13 is firstly formed on a substrate 12; and this pressure-sensitive adhesive layer 13 and an adherend 14, a SUS 304 steel plate whose surface has been polished by a water-resistant polishing paper #280 are then brought into pressure contact by a rubber roller with a load of 2 kg under the conditions of 23° C. and 65% RH. The area that is brought into pressure contact for adhesion is 25 cm×25 cm. Next, the adherend 14 is fixed under the conditions of 23° C. and 65% RH, and the substrate 12 is pulled in the direction 15 shown in FIG. 7 at a rate of 300 mm/min. The force measured at this time corresponds to shearing force.

To make the shearing force that is measured in accordance with JIS Z0237-3 fall in the range of 800 to 1600 gf, it is preferable to use, as the pressure-sensitive adhesive agent, any of various acrylic polymers such as polyacrylic esters. Specifically, it is preferable to use a polymer obtained by polymerizing an acrylic polymer whose end has been substituted with such a functional group as hydroxyl or carboxyl group.

When the shearing force measured in accordance with JIS Z0237-3 is less than 800 gf, the pressure-sensitive adhesive agent does not run off from the half-cut-provided part or the like. However, the adhesion between the seal part 9 separated from the release sheet 5 and an object 11 is poor, so that the seal part 9 adhered to the object 11 is easily separated therefrom. On the other hand, when the shearing force measured in accordance with JIS Z0237-3 is in excess of 1600 gf, although the adhesion between the seal part 9 and an object 11 is excellent, the pressure-sensitive adhesive agent tends to run off from the half-cut-provided part or the like.

The amount of the pressure-sensitive adhesive agent to be applied to form the pressure-sensitive adhesive layer 6 is generally about 8 to 30 g/m$^2$ (dry basis). The pressure-sensitive adhesive agent is applied to the surface of the release sheet 5 by a conventionally known method such as a gravure, gravure reverse or roll coating method, and then dried to form the pressure-sensitive adhesive layer 6. It is noted that the pressure-sensitive adhesive layer 6 may be formed on the substrate 7 by the above known method.

(Substrate)

A conventionally known material can be used as the substrate 7. It is preferable to use, for example, a polypropylene film containing therein microvoids (extremely small vacancies) such as "Toyopal SS P4255" (thickness: 35 μm) manufactured by Toyobo Co., Ltd., Japan, or "MW 247" (thickness: 35 μm) manufactured by Mobile Plastic Europe Corps., or a polyethylene terephthalate film containing therein microvoids such as "W-900" (thickness: 60 μm) manufactured by Dia Foil Kabushiki Kaisha, Japan or "E-60" (thickness: 60 μm) manufactured by Toray Industries, Inc., Japan.

Further, it is also possible to use, as the substrate 7, a laminate of a resin film which contains therein no microvoids and which will be brought into contact with the pressure-sensitive adhesive layer 6, and a resin film which contains therein microvoids and which will be brought into contact with the receptive layer 8. When such a laminate is used as the substrate 7, an image formed on the resulting thermal transfer image-receiving sheet 1, in particular, a high-density area of the image has increased coloring density; a high-quality image can thus be obtained. In addition, it is possible to prevent the seal part 9 from being wrinkled when the seal part 9 is separated from the release sheet 5.

In the substrate 7 made of the above-described laminate, a film of polyethylene terephthalate, polyethylene, polypropylene or the like can be used as the resin film containing therein no microvoids. The thickness of this resin film varies depending on the properties of the film and on whether the film has been oriented or not; however, it is preferably about 10 to 100 μm. When this resin film is too thin, it is limp. Therefore, wrinkles appear on the resulting thermal transfer image-receiving sheet 1 due to thermal shrinkage during the formation of an image carried out by a thermal head or the like. On the other hand, the resin film is too thick, the resulting thermal transfer image-receiving sheet 1 tends to curl due to heat setting when an image is formed by using a thermal head or the like. "Lumirror T-60" (thickness: 38 μm) manufactured by Toray Industries, Inc., Japan can be mentioned as a preferred example.

Further, a conventionally known resin film containing therein microvoids such as a polypropylene or polyethylene terephthalate film can be used as the resin film containing therein microvoids. A polypropylene film is particularly preferred because this film is excellent in both cushioning properties and insulating properties, and can allow a dye to uniformly and efficiently transfer to the receptive layer 8 when the resulting thermal transfer image-receiving sheet 1 and a thermal transfer printing sheet are brought into pressure contact by a thermal head. It is preferable that the thickness of such a resin film be approximately from 30 to 100 μm. "Toyopal P4255" (thickness: 35 μm) and "Toyopal P 4256" (thickness: 60 μm) manufactured by Toyobo Co., Ltd., Japan can be mentioned as preferred examples.

In the substrate 7 made of the above-described laminate, a known method such as dry lamination using a reaction-hardening-type (or pressure-sensitive- or heat-sensitive-type) adhesive agent dissolved in a solvent, non-solvent lamination (hot-melt lamination) using a reaction-hardening-type (or pressure-sensitive- or heat-sensitive-type) adhesive agent containing no solvent, or EC lamination can be used as a method for laminating a resin film containing therein no microvoids to one containing therein microvoids. Preferred methods are dry lamination and non-solvent lamination. Examples of adhesive agents suitable for dry lamination include "Takelack A969V" (main agent)/"Tekenate A-5" (hardening agent) (mixing ratio=3/1) manufactured by Takeda Chemical Industries, Ltd., Japan. The amount of the adhesive agent to be applied is approximately from 1 to 8 g/m$^2$, preferably from 2 to 6 g/m$^2$ on dry basis. On the other hand, "Takenate A-720L" manufactured by Takeda Chemical Industries, Ltd., Japan is mentioned as an adhesive agent suitable for non-solvent lamination.

(Receptive Layer)

The receptive layer 8 can be formed on the substrate 7 either directly or through a primer layer. The constitution of the receptive layer 8 varies depending on the type of the recording method to be employed, that is, hot-melt transfer type or sublimation transfer type. Further, in the case of hot-melt transfer recording, it is not always necessary to provide the receptive layer 8; and it is possible to thermally transfer a colored transfer layer from a thermal transfer printing sheet directly to the substrate 7. In both hot-melt transfer recording and sublimation transfer recording, the receptive layer 8 acts to receive a coloring material that is transferred from a thermal transfer printing sheet by heating. In the case where the coloring material is a sublimable dye, it is required that the receptive layer 8 receives the dye and develops its color, and, at the same time, does not re-sublime the dye once received.

In general, the main component of the receptive layer 8 is a thermoplastic resin. Examples of materials useful for 5 forming the receptive layer 8 include polyolefin resins such as polypropylene, vinyl chloride—vinyl acetate copolymers, ethylene—vinyl acetate copolymers, halogenated polymers such as polyvinylidene chloride, polyvinyl acetate, polyester resins such as polyacrylate, polystyrene resins, polyamide resins, copolymer resins of olefins such as ethylene or propylene and other vinyl monomers, ionomers, cellulosic resins such as cellulose diacetate, and polycarbonate resins. Of these, particularly preferred are polyester resins, vinyl chloride—vinyl acetate copolymers, and mixtures thereof.

In sublimation transfer recording, it is preferable to add a releasing agent to the receptive layer 8 in order to prevent, during the formation of an image, fusion between a thermal transfer printing sheet having a colored transfer layer and the receptive layer 8 of the thermal transfer image-receiving sheet 1, or to prevent the lowering of printing sensitivity. Examples of preferred releasing agents include silicone oils, phosphoric ester surface active agents, and fluorinecontaining surface active agents. Of these, silicone oils are preferred. Preferred examples of silicone oils include modified silicone oils such as epoxy-, vinyl-, alkyl-, amino-, carboxyl-, alcohol-, fluorine-, alkylaralkylpolyether-, epoxypolyether- or polyether-modified silicone oils.

It is preferable to use one of the above-enumerated releasing agents, or a mixture of two or more of them as the releasing agent that is added to the receptive layer 8. The amount of the releasing agent to be added is preferably from 0.5 to 30 parts by weight for 100 parts by weight of a composition for forming the receptive layer 8. When the amount of the releasing agent added does not fall in this range, such a trouble may be caused that a sublimation-type thermal transfer printing sheet and the receptive layer 8 of the thermal transfer image-receiving sheet 1 are fused to each other or that the printing sensitivity is lowered. When such a releasing agent is added to the receptive layer 8, the bleeding of the releasing agent occurs at the surface of the receptive layer 8 on which an image has been transferred, whereby a release layer is formed on the receptive layer 8. The releasing agent may not be incorporated into the receptive layer 8, but be applied separately to the surface of the receptive layer 8.

The receptive layer 8 can be formed in the following manner: a solution prepared by dissolving, in a proper organic solvent, the above-described resin to which additives such as a releasing agent have been added as needed, or a dispersion prepared by dispersing the resin plus additives in an organic solvent or water is applied to the substrate 7 by a proper coating method, and then dried.

When the receptive layer 8 is formed, a white pigment, a fluorescent whitening agent, or the like may be added in order to increase the whiteness of the receptive layer 8, thereby imparting further enhanced sharpness to the transferred image. The receptive layer 8 thus formed can have any thickness. In general, however, it is preferable to form the receptive layer 8 so that it will have a thickness of 1 to 50 $\mu$m when dried.

Such a receptive layer 8 is preferably a continuous layer. However, it may also be formed as a discontinuous patterned layer by the use of a resin emulsion, or a water-soluble resin or resin dispersion. Further, to stabilize the ability of the thermal transfer image-receiving sheet 1 to be carried by a thermal transfer printer, an antistatic agent may be applied to the surface of the receptive layer 8.

To prevent the thermal transfer image-receiving sheet 1 from being doubly fed to a thermal transfer printer, a slip layer (not shown in the figure) may be provided on the surface of the release sheet 5 of the thermal transfer image-receiving sheet 1, opposite to the receptive layer 8. Useful for forming the slip layer are materials obtained by adding lubricants such as a variety of fine particles or silicone to one of or mixtures of known resins such as butyral resins, polyacrylic esters, polymethacrylic esters, polyvinylidene chloride, polyesters, polyurethane, polycarbonate and polyvinyl acetate.

An antistatic layer may be provided on either the outermost surface (the receptive layer 8 side) or the outermost back surface (the release sheet 5 side) of the thermal transfer image-receiving sheet 1, or on both of these surfaces. The antistatic layer can be formed by applying a solution or dispersion prepared by dissolving or dispersing, in a solvent, an antistatic agent selected from fatty esters, sulfuric esters, phosphoric esters, amides, quaternary ammonium salts, betaines, amino acids, acrylic resins and ethylene oxide adducts. It is noted that the same method as that used for forming the receptive layer 8 described above can be used for forming the antistatic layer. It is preferable that the amount of the antistatic layer applied be from 0.001 to 0.1 g/m$^2$ on dry basis.

Further, by using various resins, an intermediate layer may be provided between the substrate 7 and the receptive layer 8 of the thermal transfer image-receiving sheet 1. By imparting various functions to this intermediate layer, it is possible to impart excellent functions to the thermal transfer image-receiving sheet 1. For instance, by using, as a resin capable of imparting cushioning properties, a resin that shows great elastic or plastic deformation such as a polyolefin, vinyl copolymer, polyurethane or polyamide resin, it is possible to improve the printing sensitivity of the thermal transfer image-receiving sheet 1, or to obtain a printed image that is not roughened. Further, to impart antistatic properties to the intermediate layer, any of the antistatic agents previously mentioned may be added to the above-described resin capable of imparting cushioning properties; this mixture is dissolved or dispersed in a solvent, and the resulting solution or dispersion is applied to form the intermediate layer.

(Process for Producing Thermal Transfer Image-Receiving Sheet)

By referring to FIGS. 2 and 3, a process for producing a thermal transfer image-receiving sheet of the aforementioned constitution will be explained.

Figure 2:
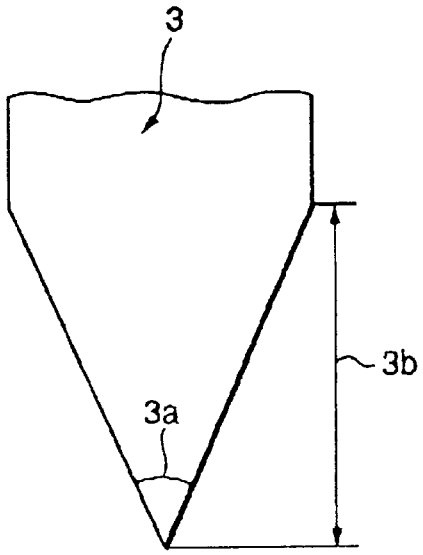
FIG. 2 is an enlarged partial sectional view showing one example of a cutter blade which is used for forming a half cut in the thermal transfer image-receiving sheet shown in FIGS. 1A and 1B.

FIG. 2 is an enlarged partial sectional view showing one example of a cutter blade that is used for forming a half cut 2 in the thermal transfer image-receiving sheet 1 shown in FIGS. 1A and 1B.

Figure 3:
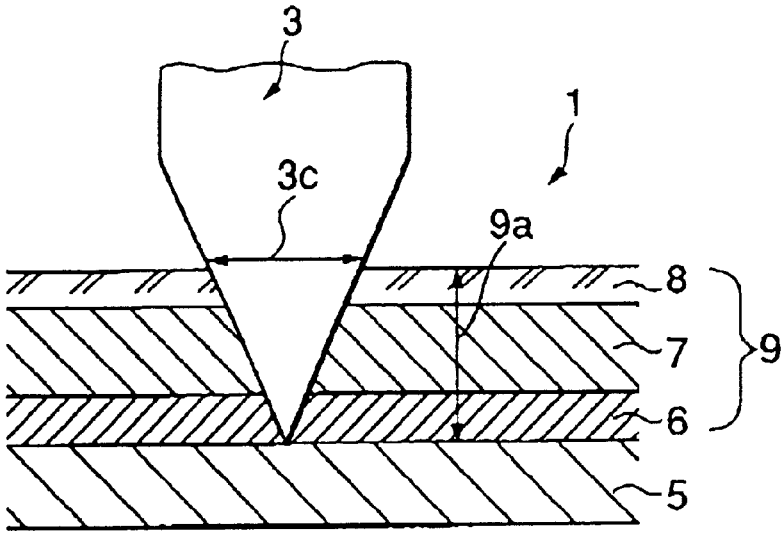
FIG. 3 is a view illustrating a process for producing the thermal transfer image-receiving sheet shown in FIGS. 1A and 1B.

FIG. 3 is a view illustrating a process for producing the thermal transfer image-receiving sheet 1 shown in FIGS. 1A and 1B, and shows how the half cut 2 is formed in the seal part 9 of the thermal transfer image-receiving sheet 1 by using the cutter blade 3 as shown in FIG. 2.

To form the half cut 2, a variety of methods can be employed; for instance, a method in which the thermal transfer image-receiving sheet 1 is placed between an upper mold equipped with the cutter blade 3 and a pedestal, and the upper mold is moved up and down, and a method using a cylinder-type rotary cutter. In any case, it is preferable to form, by using the cutter blade 3, a half cut 2 whose shape and depth meet the following requirements.

It is noted that, in the thermal transfer image-receiving sheet 1 shown in FIGS. 1A and 1B, the seal part 9 is provided with the half cut 2 for separating a part of the seal part 9 from the release sheet 5 and that the groove width of the half cut 2 falls in the range of 25 to 60 $\mu$m.

Such a groove width 2*a* of the half cut 2 can be attained when the following cutter blade is used as the cutter blade 3 for forming a half cut.

Namely, a half cut with the above-described groove width can be formed in the seal part 9 by using a cutter blade 3 whose nose angle 3*a* is from 25 to 500 and whose nose length 3*b* is greater than the thickness 9*a* of the seal part 9.

By forming a half cut with the above groove width, it is possible to avoid such a trouble that the half-cut-provided part lifts to cause, while printing is being conducted by using a thermal head, the unfavorable separation of the seal part 9 at the raised part thereof, or the running off of the pressure-sensitive adhesive agent from the seal part 9 to stick to a thermal transfer printing sheet.

From the viewpoint of production, it is unfavorable to use a cutter blade whose nose angle is less than 25°. This is because the edge of such a blade readily undergoes wear and nicks, so that it is necessary to frequently replace the cutter blade 3 with a new one. Moreover, when the cutter blade 3 is thin, the blade is easily broken. On the other hand, it is not preferable to use a cutter blade 3 whose nose angle 3*a* is in excess of 50°. This is because half cut 2 with an increased groove width 2*a* is formed when such a blade is used, causing, while printing is being conducted by using a thermal head, such a trouble that the seal part 9 is unfavorably separated or that the pressure-sensitive adhesive agent runs off from the groove to stick to a thermal transfer printing sheet.

Figure 4:
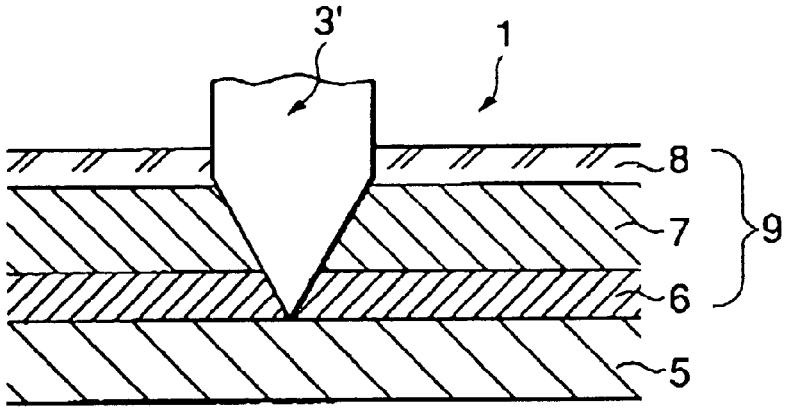
FIG. 4 is a view illustrating a conventional process for producing a thermal transfer image-receiving sheet.
Figure 5:
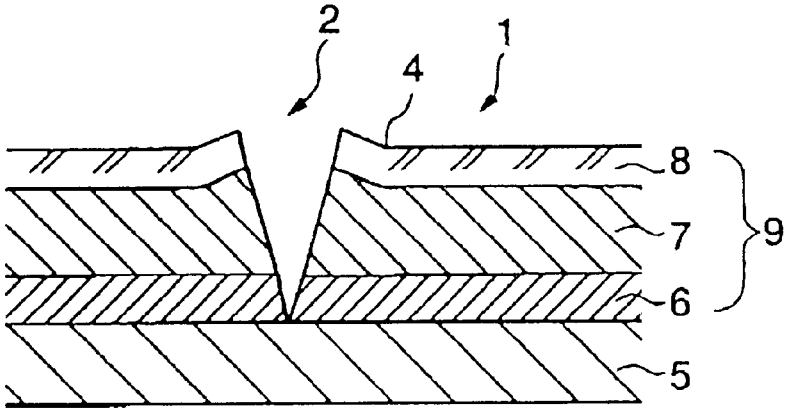
FIG. 5 is a sectional view of a thermal transfer image-receiving sheet obtained by a conventional process for producing a thermal transfer image-receiving sheet.

Further, when a cutter blade 3 whose nose length 3*b* is smaller than the thickness 9*a* of the seal part 9 is used, the edge of the blade penetrates into the thermal transfer image-receiving sheet 1 as shown in FIGS. 4 and 5. When this cutter blade 3 is withdrawn, lifting 4 occurs at the edge of the half cut formed in the seal part 9. An image cannot be formed on this raised part, so that the image finally obtained is to have voids. When it is tried to print an image on such a thermal transfer image-receiving sheet 1 by using a thermal transfer printer, the seal part 9 tends to be unfavorably separated at the half-cut-provided part due to the pressure applied by the thermal head when printing is conducted, causing such a trouble that the thermal transfer image-receiving sheet cannot be carried properly by the thermal transfer printer.

During the use of the cutter blade 3, the edge of the blade is abraded, and the nose length 3*b* of the blade is thus decreased. Therefore, by taking such a decrease in length into consideration, it is preferable to use a cutter blade 3 whose nose length 3*b* is slightly greater than the thickness 9*a* of the seal part 9.

Further, since the groove width 2*a* of the half cut 2 is preferably from 25 to 60 $\mu$m, it is preferable that the nose width 3*c* of the cutter blade 3 shown in FIG. 3 be in the range of 25 to 60 $\mu$m.

Figure 6:
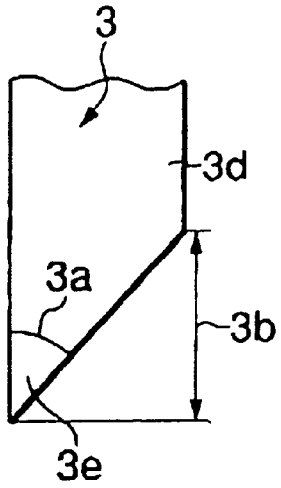
FIG. 6 is an enlarged partial sectional view showing a variation of the cutter blade shown in FIG. 2.

The cutter blade 3 may be not only double-edged one as shown in FIG. 2 but also single-edged one as shown in FIG. 6. In the case where a single-edged cutter 3 is used, a half cut 2 is formed by putting the cutter so that the root 3*d* of the cutter blade 3 faces the inside of the thermal transfer image-receiving sheet 1, in other words, the edge 3*e* of the cutter blade 3 faces the outside of the thermal transfer image-receiving sheet 1. By doing so, it is possible to prevent, when the cutter blade 3 is withdrawn, the lifting 4 of the seal part 9 which occurs in the vicinity of the edge 3*e* of the cutter blade 3; the unfavorable separation of the seal part 9 can thus be prevented.

Further, in the case where a single-edged cutter blade 3 is used, it is particularly preferable that the nose angle 3*a* of the cutter blade be from 25 to 45°. In addition, as in the case of a single-edged cutter blade, it is preferable that the nose length 3*b* of the single-edged cutter blade 3 be greater than the thickness 9*a* of the seal part 9.

A conventionally known recording method of sublimation transfer type or hot-melt transfer type can be used for forming an image on the thermal transfer image-receiving sheet 1 produced by the aforementioned process. For example, by using a thermal transfer printing sheet having a colored transfer layer on which areas of three colors of yellow, magenta and cyan are sequentially present in a single plane, a desired full-color image can be formed on the receptive layer 8 of the thermal transfer image-receiving sheet 1 by using a known thermal-head-type thermal transfer printer. The seal part 9 composed of the receptive layer 8 on which the image has been formed, the substrate 7, and the pressure-sensitive adhesive layer 6 can be separated from the release sheet 5, and adhered to any desired object 11 (see FIG. 10).

Second Embodiment

Next, the second embodiment of the present invention will be described by referring to FIGS. 11 to 16.

First of all, the outline of the thermal transfer image-receiving sheet according to the second embodiment of the present invention will be described by referring to FIGS. 14 to 16.

Figure 14:
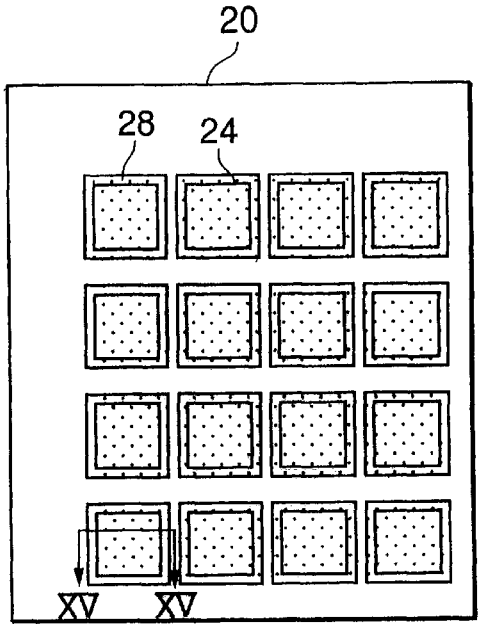
FIG. 14 is a plane view showing one example of the thermal transfer image-receiving sheet according to the second embodiment of the present invention, on which images have been formed by means of thermal transfer printing.
Figure 15:
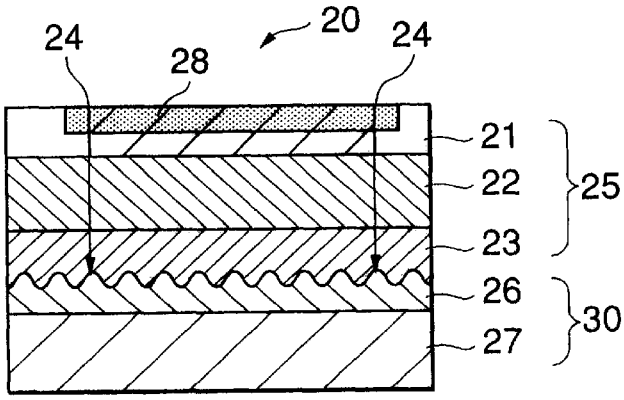
FIG. 15 is an enlarged sectional view taken along line XV—XV in FIG. 14.
Figure 16:
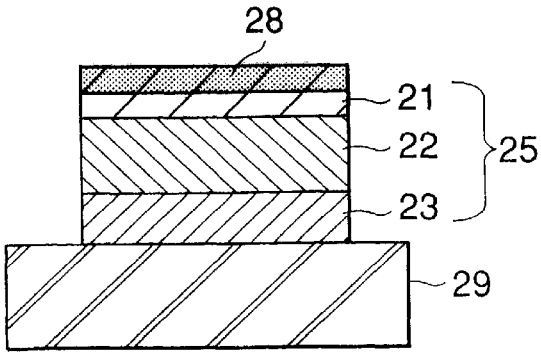
FIG. 16 is a sectional view showing the seal part separated from the thermal transfer image-receiving sheet shown in FIGS. 14 and 15, adhered to an object.

FIG. 14 is a plane view showing one example of the thermal transfer image-receiving sheet 20 according to the second embodiment of the present invention; and FIG. 15 is an enlarged sectional view taken along line XV—XV in FIG. 14. The thermal transfer image-receiving sheet 20 shown in FIGS. 14 and 15 is fed to a thermal transfer printer (not shown in the figures) in sheet form as in the case of the thermal transfer image-receiving sheet 1 according to the aforementioned first embodiment. A thermal transfer printing sheet (not shown in the figures) is superposed on the surface of the thermal transfer image-receiving sheet 20, and heat is applied image-wise to the back surface of the thermal transfer printing sheet by a thermal head or the like, whereby a colored transfer layer contained in the thermal transfer printing sheet is thermally transferred to the surface of the thermal transfer image-receiving sheet 20 to form thereon a desired image 28.

The thermal transfer image-receiving sheet 20 includes a plurality of sections, and each section is provided with a half cut 24. An image 28 is formed in each section, and a plurality of images 28 are thus located on one thermal transfer image-receiving sheet 20. It is noted that the sections to be provided with the half cut 24 can be made into any shape.

The groove width of the half cut 24 is preferably from 25 to 60 $\mu$m as in the aforementioned first embodiment. Further, the same method as that used in the above-described first embodiment can be employed to form the half cut 24.

In this thermal transfer image-receiving sheet 20, the half cut 24 penetrates a seal part 25 and reaches to the top of a releasing part (release sheet) 30. After forming an image 28, for example, a facial photographic image, in each section on the seal part 25, defined by the half cut 24, a part of the seal part 25 is separated, along the half cut 24, from the releasing part 30 together with the pressure-sensitive adhesive layer 23. This seal part 25 separated can be adhered to any desired object, for instance, a note book, a pocket book, a brief case, or the like as shown in FIG. 16.

Next, the specific constitution of such a thermal transfer image-receiving sheet 20 will be described.

Figure 11:
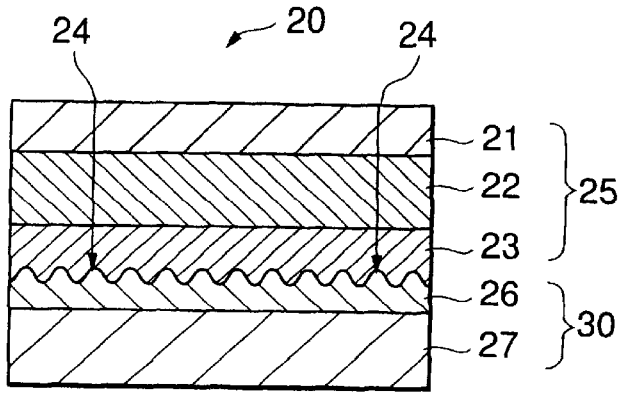
FIG. 11 is a sectional view illustrating a second embodiment of the thermal transfer image-receiving sheet according to the present invention.

FIG. 11 is a sectional view illustrating the second embodiment of the thermal transfer image-receiving sheet according to the present invention. As shown in FIG. 11, the thermal transfer image-receiving sheet 20 includes a seal part 25 including a receptive layer 21, a seal substrate 22 and a pressure-sensitive adhesive layer 23 which are laminated in the order mentioned; and a releasing part (release sheet) 30 including a release layer 26 and a release substrate 27, the pressure-sensitive adhesive layer 23 of the seal part 25 and the release layer 26 of the releasing part 30 being separably adhered to each other.

In the thermal transfer image-receiving sheet 20 according to the second embodiment of the present invention, the seal part 25 and the releasing part 30 are adhered so that they show continuous and slight changes in peel strength when the seal part 25 is separated from the releasing part 30. Specifically, these two parts are adhered to each other so that the slight changes in peel strength measured in accordance with JIS (Japanese Industrial Standards) Z0237-8.3.1 (180

Degrees Peeling Method) falls in the range of 1 to 10 g/cm, preferably 2 to 10 g/cm.

Figure 12:
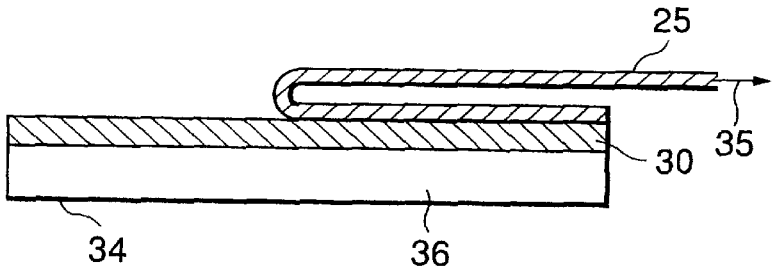
FIG. 12 is a diagrammatic view illustrating a method for measuring the peel strength between a seal part and a release sheet (releasing part)
Figure 13:
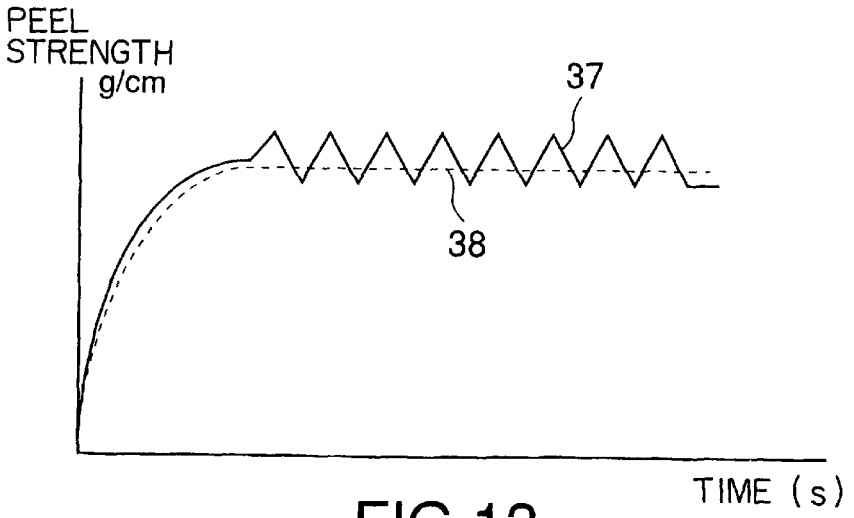
FIG. 13 is a graph showing the peel strength characteristics of the thermal transfer image-receiving sheet according to the second embodiment of the present invention.

In the above method of measurement, the seal part 25 is separated from the releasing part 30 in the direction of 180 degrees as shown in FIG. 12; the peel strength at the time when the seal part 25 is separated, in the direction 35 at a constant rate, from the releasing part 30 that has been fixed to fixing part 34 is continuously measured, and recorded on a chart.

Through this measurement, the inventors found that, even if two thermal transfer image-receiving sheets show the same average peel strength (see reference numerals 37 and 38), one which shows continuous and slight changes in peel strength, as shown by reference numeral 37, is more difficult to separate than the other. The second embodiment of the present invention was accomplished on the basis of this finding of the inventors.

The releasing part 30 and the seal part 25 (the pressure-sensitive adhesive layer 23, the seal substrate 22 and the receptive layer 21) which are the constituents of the thermal transfer image-receiving sheet 20 will be described in detail hereinafter.

(Releasing part)

The releasing part 30 is composed of the release layer 26 and the release substrate 27. The releasing part 30 is, for example, such that one surface of a conventionally known plastic film or polyethylene-coated paper (release substrate 27) (in the case of polyethylene-coated paper, the polyethylene-side surface) is treated with a known releasing agent such as silicone to form a release layer 26. Specifically, "Lumirror T-60" (thickness: 50 μm) manufactured by Toray Industries, Inc., Japan, or "W-400" (thickness: 38 μm) manufactured by Dia Foil Kabushiki Kaisha, Japan can be used. The thickness of the releasing part 30 varies depending upon the properties of the material used; it is however preferable that the thickness be in the range of 20 to 150 μm. When the thickness of the releasing part 30 is less than 20 μm, the resulting thermal transfer image-receiving sheet 20 is limp, so that it cannot be carried by a thermal transfer printer, or tends to be wrinkled. On the other hand, when the releasing part 30 is too thick, the resulting thermal transfer image-receiving sheet 20 has an excessively large thickness. An excessively heavy load is thus imposed on a thermal transfer printer while it is carrying such a thermal transfer image-receiving sheet 20. As a result, the thermal transfer printer gets out of order, or cannot properly carry the thermal transfer image-receiving sheet 20.

To attain slight changes in peel strength between the seal part 25 and the releasing part 30, it is preferable to roughen the surface of the release layer 26.

To roughen the release layer 26, there can be employed not only a method in which the release substrate 27 is roughened, but also a method in which, by applying a coating liquid for forming the release layer 26 by means of gravure coating, convex lines and/or dots are formed on the surface of the release layer 26 which will be brought into contact with the pressure-sensitive adhesive layer 23. In the latter method, it is preferable to form the convex lines and/or dots so that their height will be from 0.5 to 50.0 μm and that the gap between them will be from 0.1 to 0.5 mm.

The above-described surface roughness of the release layer 26 can be obtained in the following manner: after coating the release substrate 27 with the release layer 26, a roll whose surface is smooth or has fine irregularities is pressed against the surface of the release layer 26 to form thereon convex lines and/or dots.

For the release substrate 27, it is possible to use a polyolefin film, for example, a polyethylene or polypropylene film, whose surface has not been subjected to any treatment (corona discharge treatment to enhance adhesion, or the like). Particularly preferred are oriented or non-oriented polyethylene films. By the use of a cooling roll having the above-described surface roughness, the film surface can be shaped when a film is formed. We found that, if an oriented or non-oriented polyethylene film is used, the releasing part 30 of the thermal transfer image-receiving sheet 20 can be formed by properly selecting the type of the pressure-sensitive adhesive agent to be used, without providing the release layer. It is preferable that the peel strength between the seal part 25 and the releasing part 30, measured in accordance with the above-described JIS Z0237-8.3.1 (180 Degrees Peeling Method) be in the range of 10 to 75 g/cm.

In the thermal transfer image-receiving sheet 20 whose seal part 25 and releasing part 30 show peel strength in the above-described range, unfavorable separation is not caused at the half-cut-provided part when an image is formed by using a thermal transfer printer. Moreover, after forming an image, it is possible to separate the seal part 25 from the releasing part 30 without breaking the seal part 25.

The thickness of the release substrate 27 is from 20 to 100 μm, preferably from 35 to 75 μm.

"Crisper G1212" manufactured by Toyobo Co., Ltd., Japan, or "E-60" manufactured by Toray Industries, Inc., Japan, for example, can be used as the oriented or non-oriented polyethylene film (polyethylene terephthalate film).

Besides these films, it is also possible to use oriented or non-oriented films of polymethyl pentene, polyethylene terephthalate, polyethylene naphthalate, polyamide, polyimide, polystyrene, polyvinyl chloride, polyvinylidene chloride, polyvinyl alcohol, ethylene-vinyl alcohol copolymer, polycarbonate, fluorocarbon resin, polymethylmethacrylate, polybutene-1, polyether ether ketone, polysulfone, polyether sulfone, polyphenylene sulfide or the like.

Moreover, plastic films containing therein microvoids can also be used.

(Pressure-Sensitive Adhesive Layer)

For the pressure-sensitive adhesive layer 23, pressure-sensitive adhesive agents obtained by dissolving conventionally known resins or rubber in organic solvents, or by dissolving or dispersing known resins or rubber in aqueous solvents can be used. Useful for preparing the pressure-sensitive adhesive agents are, for example, polyvinyl acetate, acrylic resins, vinyl acetate—acrylic copolymers, vinyl chloride—vinyl acetate copolymers, ethylene—vinyl acetate copolymers, polyurethane, natural rubber, chloroprene rubber, nitrile rubber, and the like.

The amount of the pressure-sensitive adhesive layer 23 to be applied is usually from 8 to 30 g/m$^2$ (dry basis). A coating method is properly selected from conventionally known ones such as gravure, gravure reverse, roll, comma, die, bar, and air knife coating methods depending upon the properties and amount of the pressure-sensitive adhesive agent to be applied; the pressure-sensitive adhesive agent is applied by the selected method so that it can fully enter into the concavities in the release layer 26 of the releasing part 30; volatile components are dried to form the pressure-sensitive adhesive layer 23; and this pressure-sensitive adhesive layer 23 is brought into close contact with the seal substrate 22 to obtain the thermal transfer image-receiving sheet 20. It is noted that the pressure-sensitive adhesive layer 23 may also be formed directly on the substrate 22 by the same method as the above.

To make the pressure-sensitive adhesive agent thoroughly enter into the concavities in the release layer 26, it is preferable to use a coating liquid for forming the pressure-sensitive adhesive layer 23 whose viscosity has been adjusted to 20 to 60 seconds, preferably 30 to 40 seconds (when measured by a zahn cup #3). It is difficult to control the amount of the coating liquid to be applied when its viscosity is low. On the other hand, when the viscosity of the coating liquid is high, the pressure-sensitive adhesive agent cannot enter into the concavities in the release layer 26. It is therefore difficult to obtain slight changes in peel strength.

In addition, it is preferable to form the pressure-sensitive adhesive layer 23 by selecting the type and amount of the pressure-sensitive adhesive agent to be applied, and the shape and properties of the release layer 26 so that the peel strength between the seal part 25 and the releasing part 30 fall in the range of 10 to 75 g/cm, preferably 10 to 50 g/cm when measured in accordance with JIS Z0237-8.3.1 (180 Degrees Peeling Method).

(Seal Substrate)

A conventionally known material can be used for the seal substrate 22. It is preferable to use, for example, a polypropylene film containing therein microvoids (extremely small vacancies) such as "Toyopal SS P4255" (thickness: 35 μm) manufactured by Toyobo Co., Ltd., Japan, or "MW 247" (thickness: 35 μm) manufactured by Mobile Plastic Europe Corp, or a polyethylene terephthalate film containing therein microvoids (extremely small vacancies) such as "W-900" (thickness: 50 μm) manufactured by Dia Foil Kabushiki Kaisha, Japan or "E-60" (thickness: 50 μm) manufactured by Toray Industries, Inc., Japan.

Further, it is also possible to use, as the seal substrate 22, a laminate of a resin film which contains therein no microvoids and which will be brought into contact with the pressure-sensitive adhesive layer 23, and a resin film which contains therein microvoids and which will be brought into contact with the receptive layer 21. When such a laminate is used as the seal substrate 22, an image formed on the resulting thermal transfer image-receiving sheet 20, especially a high-density area of the image shows improved color development; a high-quality image can thus be obtained. In addition, it is possible to prevent the seal part 25 from being wrinkled when the seal part 25 is separated from the releasing part 30.

In the seal substrate 22 made of the above-described laminate, a film of polyethylene terephthalate, polyethylene, polypropylene or the like can be used as the resin film containing therein no microvoids. The thickness of this resin film varies depending on the properties of the film and on whether the film has been oriented or not; however, the thickness is preferably about 10 to 50 μm. When this resin film is too thin, it is limp. Therefore, wrinkles tend to appear on the resulting thermal transfer image-receiving sheet 20 due to thermal shrinkage during the formation of an image carried out by a thermal head or the like. On the other hand, the resin film is too thick, the resulting thermal transfer image-receiving sheet 20 tends to curl due to heat setting while an image is being formed by using a thermal head or the like. "Lumirror S-10" (thickness: 38 μm) manufactured by Toray Industries, Inc., Japan can be mentioned as a preferred example.

Further, a conventionally known resin film containing therein microvoids such as a polypropylene or polyethylene terephthalate film can be used as the resin film containing therein microvoids. A polypropylene film is particularly preferred because this film is excellent in both cushioning properties and insulating properties, and can allow a dye to uniformly and efficiently transfer to the receptive layer 21 when the resulting thermal transfer image-receiving sheet 20 and a thermal transfer printing sheet are brought into pressure contact by a thermal head. It is preferable that the thickness of such a resin film be approximately 30 to 60 μm. "Toyopal P4255" (thickness: 35 μm) and "Toyopal P 4256" (thickness: 60 μm) manufactured by Toyobo Co., Ltd., Japan are preferred examples.

In the case where the above-described laminate is used as the seal substrate 22, a conventionally known method such as dry lamination using a reaction-hardening-type (or pressure-sensitive- or heat-sensitive-type) adhesive agent dissolved in a solvent, non-solvent lamination (hot-melt lamination) using a reaction-hardening-type (or pressure-sensitive- or heat-sensitive-type) adhesive agent containing no solvent, or sandwich lamination for laminating two films in which a melt-extruded thermoplastic resin is placed between the films can be used as a method for laminating a resin film containing therein no microvoids to one containing therein microvoids. Preferred methods are dry lamination and non-solvent lamination. Examples of adhesive agents suitable for dry lamination include "Takelack A969V" (main agent)/"Tekenate A-5" (hardening agent) (mixing ratio=3/1) manufactured by Takeda Chemical Industries, Ltd., Japan. The amount of the adhesive agent to be applied is from about 1 to 8 g/m$^2$, preferably from 2 to 6 g/m$^2$ on dry basis. On the other hand, "Takenate A-720L" manufactured by Takeda Chemical Industries, Ltd., Japan can be mentioned as an adhesive agent suitable for non-solvent lamination.

(Receptive Layer)

The receptive layer 21 can be formed on the seal substrate 22 either directly or through a primer layer. The constitution of the receptive layer 21 varies depending upon the type of the recording method to be employed, that is, hot-melt transfer type or sublimation transfer type. Further, in the case of hot-melt transfer recording, it is not always necessary to provide the receptive layer 21, and it is possible to thermally transfer a colored transfer layer from a thermal transfer printing sheet directly to the seal substrate 22. In both hot-melt transfer recording and sublimation transfer recording, the receptive layer 21 acts to receive a coloring material that is transferred from a thermal transfer printing sheet by heating. In the case where the coloring material is a sublimable, it is required that the receptive layer 21 receives the dye and develops its color, and, at the same time, does not re-sublime the dye once received.

In general, the main component of the receptive layer 21 is a thermoplastic resin. Examples of materials useful for forming the receptive layer 21 include ethylene—vinyl acetate copolymers, polyolefins such as polypropylene, copolymers of olefin monomers and other vinyl monomers, ionomers, cellulosic derivatives such as cellulose diacetate, vinyl chloride—vinyl acetate copolymers, halogenated polymers such as polyvinylidene chloride, polyvinyl acetate, polyesters such as polyacrylic esters and linear polyesters, polystyrene resins, polycarbonate resins, and polyamide. Of these, particularly preferred are polyesters, vinyl chloride—vinyl acetate copolymers, and mixtures thereof.

In sublimation transfer recording, it is preferable to add a releasing agent to the receptive layer 21 in order to prevent, during the formation of an image, fusion between a thermal transfer printing sheet having a colored transfer layer and the receptive layer 21 of the thermal transfer image-receiving sheet 20, or to prevent the lowering of printing sensitivity. Examples of preferred releasing agents include silicone oils, phosphoric ester surface active agents, and fluorinecontaining surface active agents. Of these, silicone oils are preferred. Preferred examples of silicone oils include modified silicone oils such as epoxy-, vinyl-, alkyl-, amino-, carboxyl-, alcohol-, fluorine-, alkylaralkylpolyether-, epoxypolyether-, or polyether-modified silicone oils.

It is preferable to use one of the above-enumerated releasing agents, or a mixture of two or more of them as the releasing agent that is added to the receptive layer 21. The amount of the releasing agent to be added is preferably 0.5 to 30 parts by weight for 100 parts by weight of a composition for forming the receptive layer 21. When the amount of the releasing agent added does not fall in the above-described range, such a trouble may be caused that a sublimation-type thermal transfer printing sheet and the receptive layer 21 of the thermal transfer image-receiving sheet 20 are fused to each other or that the printing sensitivity is lowered. When such a releasing agent is added to the receptive layer 21, the bleeding of the releasing agent occurs at the surface of the receptive layer 21 on which an image has been transferred, whereby a release layer is formed on the receptive layer 21. The releasing agent may not be incorporated into the receptive layer 21, but be applied separately to the surface of the receptive layer 21.

The receptive layer 21 can be formed in the following manner: a solution prepared by dissolving, in a proper organic solvent, the above-described resin to which additives such as a releasing agent have been added as needed, or a dispersion prepared by dispersing the resin plus additives in an organic solvent or water is applied to the seal substrate 22 by a proper coating method, and then dried.

When the receptive layer 21 is formed, a white pigment, a fluorescent whitening agent, or the like may be added in order to increase the whiteness of the receptive layer 21, thereby imparting further enhanced sharpness to the transferred image. The receptive layer 21 thus formed can have any thickness. In general, however, it is preferable to form the receptive layer 21 so that it will have a thickness of 1 to 50 $\mu$m when dried.

Such a receptive layer 21 is preferably a continuous layer. However, it may also be formed as a discontinuous patterned layer by using a dispersion or a water-soluble resin. Further, to stabilize the ability of the thermal transfer image-receiving sheet 20 to be carried by a thermal transfer printer, an antistatic agent may be applied to the surface of the receptive layer 21.

To prevent the thermal transfer image-receiving sheet 20 from being doubly fed to a thermal transfer printer, a slip layer (not shown in the figure) may be provided on the release-substrate-side surface of the thermal transfer image-receiving sheet 20, opposite to the receptive layer 21. Useful for forming the slip layer are materials containing, as binders, known resins such as polyvinyl butyral, polyacrylic esters, polymethacrylic esters, polyvinylidene chloride, linear polyesters, polyurethane, polycarbonate and polyvinyl acetate, and lubricants such as a variety of fine particles or silicone.

An antistatic layer may be provided either on the outermost surface (the receptive layer 21 side) or the outermost back surface (the release substrate 27 side) of the thermal transfer image-receiving sheet 20, or on both of these surfaces. The antistatic layer can be formed by applying a solution or dispersion prepared by dissolving or dispersing, in a solvent, an antistatic agent selected from fatty esters, sulfuric esters, phosphoric esters, amides, quaternary ammonium salts, betaines, amino acids, acrylic resins and ethylene oxide adducts. It is noted that the same method as that used for forming the receptive layer 21 described above can be used for forming the antistatic layer. The amount of the antistatic layer to be applied is preferably from 0.001 to 0.1 g/m$^2$ on dry basis.

Further, by using various resins, an intermediate layer may be provided between the seal substrate 22 and the receptive layer 21 of the thermal transfer image-receiving sheet 20. By imparting various functions to this intermediate layer, it is possible to impart excellent functions to the thermal transfer image-receiving sheet 20. For instance, by using, as a resin capable of imparting cushioning properties, a resin that shows great elastic or plastic deformation such as a polyolefin, vinyl copolymer, polyurethane or polyamide resin, it is possible to improve the printing sensitivity of the thermal transfer image-receiving sheet 20, or to obtain a printed image that is not roughened. Further, to impart antistatic properties to the intermediate layer, any of the previously-mentioned antistatic agents may be added to the above-described resin capable of imparting cushioning properties; this mixture is dissolved or dispersed in a solvent, and the resulting solution or dispersion is applied to form the intermediate layer.

To produce the thermal transfer image-receiving sheet 20 of the above-described constitution, the same process as in the aforementioned first embodiment can be employed.

EXAMPLES

Specific examples of the aforementioned embodiments of the present invention will be given hereinafter. Examples and Comparative Examples mentioned here are focused on the second embodiment described above. In the following description, quantities expressed in "part" and "%" are based on weight.

Example 1

A substrate for a receptive layer was firstly made in the following manner. A primer-layer-forming coating liquid having the following composition was applied to one surface of a polyethylene terephthalate film having therein microvoids (trade name "Lumirror E-63 #50" manufactured by Toray Industries, Inc., Japan, thickness: 50 $\mu$m) in an amount of 1.0 g/m$^2$ on dry basis, and then dried to form a primer layer. To this primer layer, a receptive-layer-forming coating liquid having the following composition was further applied in an amount of 4.0 g/m$^2$ on dry basis, and then dried to form a receptive layer.

<Composition of Primer-Layer-Forming Coating Liquid>

| | |
|---|---|
| Urethane resin ("DP Urethane" manufactured by Showa Ink Kogyosho, K.K., Japan) | 60 parts |
| Hardening agent ("Coronate 2030" manufactured by Nippon Polyurethane Industry Co., Ltd., Japan) | 1 part |
| Methyl ethyl ketone/toluene (1/1) | 20 parts |

<Composition of Receptive-Layer-Forming Coating Liquid>

| | |
|---|---|
| Vinyl chloride-vinyl acetate copolymer ("#1000A" manufactured by Denki Kagaku Kogyo K.K., Japan) | 40 parts |
| Polyester resin ("Vylon 600" manufactured by Toyobo Co., Ltd., Japan) | 40 parts |
| Vinyl chloride-styrene-acrylic copolymer ("Denkalack #400A" manufactured by Denki Kagaku Kogyo K.K., Japan) | 20 parts |

-continued

| | |
|---|---|
| Vinyl-modified silicone ("X-62-1212" manufactured by Shin-Etsu Chemical Co., Ltd., Japan) | 10 parts |
| Catalyst ("CAT-PLR-5" manufactured by Shin-Etsu Chemical Co., Ltd., Japan) | 5 parts |
| Catalyst ("CAT-PL-50T" manufactured by Shin-Etsu Chemical Co., Ltd., Japan) | 6 parts |
| Methyl ethyl ketone/toluene (1/1) | 400 parts |

Next, 10 g/m$^2$ (dry basis) of a pressure-sensitive adhesive agent having the following composition was applied to the other surface, the surface opposite to the receptive-layer-formed surface, of the above-described polyethylene terephthalate film containing therein microvoids, and dried by heating at 70° C. for 60 seconds, thereby forming a pressure-sensitive adhesive layer.

It is noted that the shearing force of this pressure-sensitive adhesive layer of Example 1, measured in accordance with JIS Z0237-3 was 10 N (≈1020 kgf).

<Composition of Coating Liquid for Forming Pressure-Sensitive Adhesive Layer>

| | |
|---|---|
| Acrylic copolymer ("SK Dyne 1310L" manufactured by Soken Chemical & Engineering Co., Ltd., Japan) | 48 parts |
| Epoxy resin (Hardening agent "E-AX" manufactured by Soken Chemical & Engineering Co., Ltd., Japan) | 0.36 parts |
| Ethyl acetate | 51.64 parts |

On the other hand, 0.1 g/m$^2$ (dry basis) of a release-layer-forming coating liquid having the following composition was applied, by means of gravure coating using a cellular plate, to one surface of a release sheet, a biaxially oriented polyethylene terephthalate film (trade name "Crisper G1212" manufactured by Toyobo Co., Ltd., Japan, thickness: 100 μm) whose surface had been subjected to corona discharge treatment. Before drying this layer applied, a smoothing roll having a smooth surface was pressed against its surface. Thereafter, this layer was dried in front of a drying hood at 130° C. for 15 seconds to form a release layer. This release layer and the above-prepared laminate were then laminated with the surface of the release layer facing the pressure-sensitive adhesive layer of the laminate. In this step, the viscosity of the coating liquid (measured by a zahn cup #3) was 15 seconds.

<Composition of Release-Layer-Forming Coating Liquid>

| | |
|---|---|
| Addition-polymerization-type silicone ("KS-847H" manufactured by Shin-Etsu Chemical Co., Ltd., Japan) | 100 parts |
| Catalyst ("CAT-PL-50T" manufactured by Shin-Etsu Chemical Co., Ltd., Japan) | 1 part |
| Toluene | 200 parts |

To the surface of the receptive layer, a quaternary ammonium chloride compound (a 1/1000 dilute solution of "TB-34" manufactured by Matsumoto Yushi-Seiyaku Company, Ltd., Japan) was applied as the antistatic agent. A half cut was then formed in the seal part as shown in FIG. 14 by a pressing method using an upper mold equipped with the following cutter blade, and a pedestal in combination, thereby producing a thermal transfer image-receiving sheet of Example 1 (cut into a sheet with the dimensions of 10 cm long by 15 cm broad, for instance). It is noted that the thickness of the seal part of the thermal transfer image-receiving sheet of Example 1 is 65 μm.

<Cutter Blade>

A double-edged blade having a thickness of 0.71 mm, a nose angle of 42°, and a nose length of 0.9 mm.

Example 2

A thermal transfer image-receiving sheet of Example 2 was produced by using the same materials and steps as those used in Example 1 except that the cutter blade used in Example 1 was changed to the following one. It is noted that the thickness of the seal part of the thermal transfer image-receiving sheet of Example 2 is 65 μm.

<Cutter Blade>

A double-edged blade having a thickness of 0.71 mm, a nose angle of 50°, and a nose length of 0.8 mm.

Example 3

A thermal transfer image-receiving sheet of Example 3 was produced by using nearly the same materials and steps as those used in Example 1 except that a pressure-sensitive adhesive layer was formed on the release layer on the release sheet and that the substrate and the release sheet were laminated under the conditions of 100° C. and 12 seconds with the other surface of the substrate (the surface opposite to the receptive layer) facing the pressure-sensitive adhesive layer provided on the release sheet. In Example 3, the pressure-sensitive adhesive layer was formed by applying, to the release layer on the release sheet, 10 g/m$^2$ (dry basis) of a pressure-sensitive adhesive agent having the same composition as that of the pressure-sensitive adhesive agent used in Example 1. Further, a quaternary ammonium chloride compound (a 1% solution of "TB-34" manufactured by Matsumoto Yushi-Seiyaku Company, Ltd., Japan) was used as the antistatic agent to be applied to the surface of the receptive layer. It is noted that the thickness of the seal part of the thermal transfer image-receiving sheet of Example 3 is 65 μm.

Comparative Example 1

A thermal transfer image-receiving sheet of Comparative Example 1 was produced by using the same materials and steps as those used in Example 1 except that the viscosity of the silicone (coating liquid) used in Example 1 was changed to 11 seconds. It is noted that the thickness of the seal part of the thermal transfer image-receiving sheet of Comparative Example 1 is 65 μm.

Comparative Example 2

A thermal transfer image-receiving sheet of Comparative Example 2 was produced by using the same materials and steps as those used in Example 1 except that the viscosity of the silicone (coating liquid) used in Example 1 was changed to 20 seconds. It is noted that the thickness of the seal part of the thermal transfer image-receiving sheet of Comparative Example 2 is 65 μm.

Comparative Example 3

A thermal transfer image-receiving sheet of Comparative Example 3 was produced by using the same materials and steps as those used in Example 1 except that the cutter blade used in Example 1 was changed to the following one. It is noted that the thickness of the seal part of the thermal transfer image-receiving sheet of Comparative Example 3 is 65 μm.

<Cutter Blade>

A double-edged blade having a thickness of 0.71 mm, a nose angle of 60°, and a nose length of 0.6 mm.

Results of Evaluation

The above-obtained thermal transfer image-receiving sheets of Examples 1 to 3 and Comparative Examples 1 to 3 were evaluated by subjecting them to thermal transfer printing under the following conditions.

(1) Peel Strength

The release substrate of the releasing part of each thermal transfer image-receiving sheet and a 0.3-mm thick stainless steel plate (fixing plate) were faced, and fixed to each other with a double-sided pressure-sensitive adhesive tape. This was subjected to the measurement according to JIS Z0237-8.3.1 (180 Degrees Peeling Method). Namely, the thermal transfer image-receiving sheet was notched in the lengthwise direction at an interval of 1 cm; the pressure-sensitive adhesive layer and the release layer of this sample were separated from each other at a rate of 30 cm/min, and changes in peel strength were continuously recorded on a chart; and the maximum and minimum values of the peel strength for a width of 1 cm were determined.

(2) Voids in Printed Image

A thermal transfer printing sheet having a dye layer, serving as the colored transfer layer, on which areas of three colors of yellow, magenta and cyan were sequentially present in a single plane (manufactured by Dai Nippon Printing Co., Ltd., Japan) was superposed on each one of the above-described thermal transfer image-receiving sheets of Examples and Comparative Examples with the colored transfer layer of the thermal transfer printing sheet facing the receptive layer of the thermal transfer image-receiving sheet. Recording was conducted by applying heat to the back surface of the heat transfer printing sheet by using the thermal head of a thermal transfer printer under the following conditions to form a full-color facial photographic image on the receptive layer of the thermal transfer image-receiving sheet; the voltage applied by the head, 12.0 V; the pulse width, 16 msec; the printing cycle, 33.3 msec; and the dot density, 6 dots/line. The printing was herein conducted so that the section surrounded by the half cut would be included in each facial photographic image formed on the thermal transfer image-receiving sheet.

(3) Ability of Being Carried by Printer

Each one of the thermal transfer image-receiving sheets of Examples and Comparative Examples was cut into sheet form; 100 sheets of each image-receiving sheet were continuously fed to a printer, "UPC200" manufactured by SONY Corporation, Japan; and the rate of occurrence of troubles such as peeling was evaluated.

(4) Appearance of Wrinkles upon Separation

The seal part was separated from each one of the thermal transfer image-receiving sheets of Examples and Comparative Examples by hand, and visually observed in terms of the appearance of wrinkles.

Evaluation criteria:

O: Wrinkling is not observed;

X: Wrinkling is observed.

The results of the evaluation are shown in the table below.

(Results of Evaluation)

| | | Unit | Example 1 | Example 2 | Example 3 | Comparative Example 1 | Comparative Example 2 | Comparative Example 3 |
|---|---|---|---|---|---|---|---|---|
| Peel Strength | Maximum Value | g/cm | 10.5 | 10.7 | 10.5 | 4.5 | 20.6 | 10.5 |
| | Minimum Value | | 4.2 | 4.3 | 4.2 | 3.8 | 7.2 | 4.3 |
| Voids in Printed image | | The number of defective | 0/10 | 0/10 | 0/10 | 0/10 | 0/10 | 10/10 |
| Ability of Being Carried by Printer | | The number of defective samples | 0/100 | 0/100 | 0/100 | 4/100 | 0/100 | 0/100 |
| Appearance of Wrinkles | | Visual observation | ○ | ○ | ○ | ○ | X | ○ |
| Slight Changes in Peel Strength | | Visual observation | Observed | Observed | Observed | Nil | Nil | Observed |

The groove width of the half cut in the thermal transfer image-receiving sheets of Examples 1 and 3 was 50 μm, and that of the half cut formed in the thermal transfer image-receiving sheet of Example 2 was 60 μm. In the thermal transfer image-receiving sheets of Examples 1, 2 and 3, the half-cut-provided parts did not lift at all. Therefore, while printing was being conducted by using a thermal head, these thermal transfer image-receiving sheets were free from such troubles as the unfavorable separation of the seal part at its raised part and that the running off of the pressure-sensitive adhesive agent from the seal part to stick to the thermal transfer printing sheet.

On the contrary, in the thermal transfer image-receiving sheet of Comparative Example 3, the groove width of the half cut was 75 μm. The half-cut-provided part of this image-receiving sheet lifted, and the seal part was unfavorably separated at this raised part when printing was conducted by using a thermal head. Moreover, in some samples of this image-receiving sheet, the pressure-sensitive adhesive agent ran off from the seal part to stick to the thermal transfer printing sheet.

What is claimed is:

1. A thermal transfer image-receiving sheet comprising:

a seal part including at least a receptive layer, a substrate and a pressure-sensitive adhesive layer that are laminated in the order mentioned; and a release sheet separably adhered to the pressure-sensitive adhesive layer of the seal part, wherein the seal part is provided with a half cut for separating a part of the seal part from the release sheet and wherein the half cut has a groove width of 25 to 60 μm.

2. The thermal transfer image-receiving sheet according to claim 1, wherein the pressure-sensitive adhesive layer of the seal part shows a shearing force ranging from 800 to 1600 gf when measured in accordance with JIS Z0237-3.

3. The thermal transfer image-receiving sheet according to claim 1, wherein the receptive layer of the seal part contains an antistatic agent.

4. The thermal transfer image-receiving sheet according to claim 1, wherein the substrate of the seal part is made of a laminate of a film having therein extremely small vacancies, and a film having therein no extremely small vacancies.

5. The thermal transfer image-receiving sheet according to claim 1, wherein the seal part further includes, between the receptive layer and the substrate, an intermediate layer capable of imparting a cushioning property.

6. The thermal transfer image-receiving sheet according to claim 5, wherein the intermediate layer contains an antistatic agent.

7. A thermal transfer image-receiving sheet comprising:

a seal part including at least a receptive layer, a substrate and a pressure-sensitive adhesive layer that are laminated in the order mentioned; and a release sheet separably adhered to the pressure-sensitive adhesive layer of the seal part, wherein the seal part and the release sheet are adhered to each other so that they show continuous and slight changes in peel strength when the seal part is separated from the release sheet, wherein the seal part is provided with a half cut for separating a part of the seal from the release sheet, said half cut having a groove width of 25 to 60 $\mu$m.

8. The thermal transfer image-receiving 'sheet according to claim 7, wherein the slight changes in peel strength measured by the 180 Degrees Peeling Method according to JIS Z0237-8.3.1 are in the range of 1 to 10 g/cm.

9. The thermal transfer image-receiving sheet according to claim 8, wherein the mean peel strength is from 10 to 75 g/cm.

10. The thermal transfer image-receiving sheet according to claim 7, wherein the releasing face of the release sheet is roughened.

11. The thermal transfer image-receiving sheet according to claim 10, wherein the release sheet includes a release layer that is in contact with the pressure-sensitive adhesive layer, and a release substrate that supports the release layer, and wherein the release layer has a roughened surface.

12. The thermal transfer image-receiving sheet according to claim 10, wherein the release sheet includes a release layer that is in contact with the pressure-sensitive adhesive layer, and a release substrate that supports the release layer, and wherein the release substrate has a roughened surface.

13. A process for producing a thermal transfer image-receiving sheet, comprising the steps of:

preparing a thermal transfer image-receiving sheet comprising a seal part including a receptive layer, a substrate and a pressure-sensitive adhesive layer that are laminated in the order mentioned, and a release sheet separably adhered to the pressure-sensitive adhesive layer of the seal part; and putting a cutter blade in the seal part of the thermal transfer image-receiving sheet to form a half cut with a groove width of 25 to 60 $\mu$m, for separating a part of the seal part from the release sheet.

14. The process for producing a thermal transfer image-receiving sheet according to claim 13, wherein the cutter blade has a nose angle of 25 to 50° and a nose length greater than the thickness of the seal part.

* * * * *